US005950811A

United States Patent [19]

Kautz et al.

[11] Patent Number: 5,950,811

[45] Date of Patent: Sep. 14, 1999

[54] ELECTRICAL SWITCH WITH USER SELECTABLE MANUAL/AUTOMATIC RESET

[75] Inventors: Thomas O. Kautz, Mequon; Frank J. Stier, South Milwaukee, both of Wis.

[73] Assignee: Johnson Controls Technology Co., Plymouth, Mich.

[21] Appl. No.: 09/099,795

[22] Filed: Jun. 18, 1998

[51] Int. Cl.[6] ..... H01H 73/00

[52] U.S. Cl. ..... 200/407

[58] Field of Search ..... 200/407, 408, 200/451, 406; 337/37, 56, 57, 299, 348

[56] References Cited

U.S. PATENT DOCUMENTS

| | | | |
|---|---|---|---|
| Re. 28,578 | 10/1975 | Burch et al. | 200/407 |
| 3,781,744 | 12/1973 | Olson | 337/118 |
| 3,924,213 | 12/1975 | Semple | 337/130 |
| 3,946,352 | 3/1976 | Nelson | 337/361 |
| 4,032,734 | 6/1977 | Burch | 200/407 |
| 4,297,552 | 10/1981 | Lauritsen et al. | 200/83 P |
| 4,325,046 | 4/1982 | Burch | 337/56 |
| 4,424,506 | 1/1984 | Burch | 337/365 |
| 4,796,355 | 1/1989 | Burch et al. | 29/622 |
| 5,001,317 | 3/1991 | Atkinson et al. | 200/83 Y |
| 5,565,666 | 10/1996 | Kautz | 200/83 P |
| 5,790,010 | 8/1998 | Schwab | 337/365 |

*Primary Examiner*—Renee S. Luebke
*Attorney, Agent, or Firm*—Quarles & Brady LLP

[57] ABSTRACT

An electrical switch has a snap action blade with a contact pad. The snap action blade toggles between a first configuration at which the contact pad abuts a stationary contact and a second configuration at which the contact pad is remote from the stationary contact. An actuator moves the snap action blade between the first and second configurations. A reset spring has a first position which biases the movable contact into one of the first and second configurations, and has a second position at which that biasing does not occur. A reset selector acts to determine whether the reset spring is in the first or second position. A manual reset actuator is provided to move the snap action blade into the one of the first and second configurations when the reset spring is in the second position. Operation of the reset selector selects whether the switch is in an automatic reset mode or a manual reset mode.

12 Claims, 4 Drawing Sheets

ELECTRICAL SWITCH WITH USER SELECTABLE MANUAL/AUTOMATIC RESET

BACKGROUND OF THE INVENTION

The present invention relates to switches having an electrical contact that moves from a first state to a second state when acted upon by an actuator; and more particularly to such switches which include a reset mechanism for returning the contact to the first state when no longer acted upon by the actuator.

U.S. Pat. No. 5,565,666 discloses a switch for interrupting an electrical circuit in response to a mechanical condition, such as an over pressure or under pressure condition detected in a conduit. The switch includes a support arm that is electrically connected to an electrical terminal and movable between a first position and a second position in response to the mechanical condition. The switch includes a snap action blade operatively connected to the support arm. The snap action blade levers from a first configuration to a second configuration when the support arm moves from the first position to the second position. The contact fixed to the snap action blade engages a contact connected to another electrical terminal to complete the electrical circuit in the first configuration. In the second configuration, the snap action blade disengages the contact to interrupt the electrical circuit. The snap action blade is stable in both the first and second configurations and remains in the respective configuration until acted upon by an external force.

This type of switch further includes a reset actuator disposed to engage the snap action blade in response to manual activation. The snap action blade levers from the second configuration to the first configuration only when the reset actuator engages the snap action blade and the support arm is not in the second position. Thus the only way in which the snap action blade can be returned to the first configuration to complete the electric circuit is upon manual activation of the reset actuator. This reset is referred to as being "manual" in that it requires activation of the reset actuator even though such activation may be controlled by a mechanical actuator which does not require human intervention.

SUMMARY OF THE INVENTION

A general object of the present invention is to provide an electrical switch which allows the user to select between manual and automatic reset operation.

Another object of the present invention is to allow the user to reversibly select either manual or automatic reset operation.

These and other objectives are satisfied by an electrical switch having at least one stationary contact and a movable contact. The movable contact can be alternately placed into a first configuration at which it abuts the stationary contact and a second configuration at which the movable contact is remote from the stationary contact. A switch actuator produces movement of movable contact into one of the first and second configurations.

A reset spring has a first position at which the movable contact is biased into the other of the first and second configurations. In a second position, the reset spring is disengaged from the movable contact. A reset selector operatively determines whether the reset spring is in the first position or the second position and thus whether the switch is in an automatic reset mode or a manual reset mode.

DETAILED DESCRIPTION OF THE INVENTION

Figure 1:
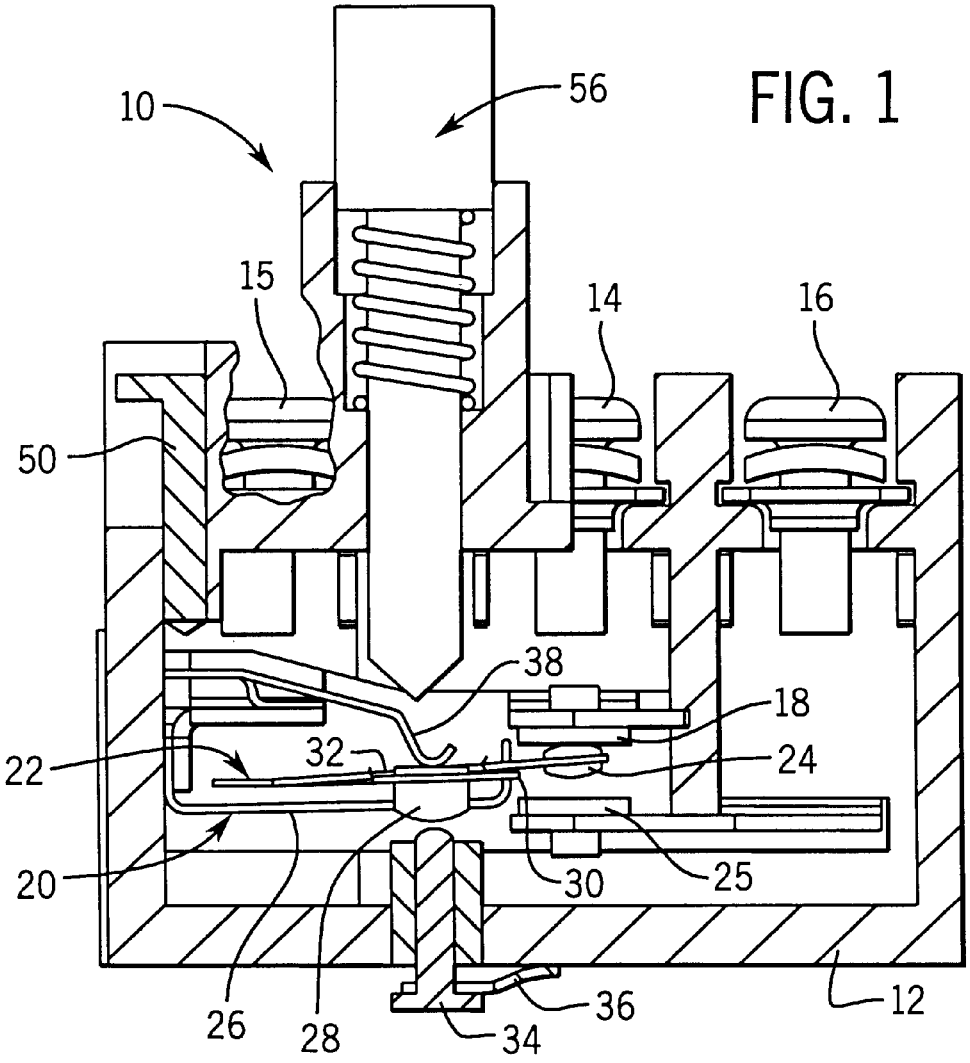
FIG. 1 is a cross sectional view through a switch that incorporates the present invention showing the contacts in a normally closed position.

With initial reference to FIG. 1, an electrical switch 10 includes a housing, or body, 12 of an electrically insulating material, such as plastic. The housing has three terminals 14, 15, and 16, which enable connection of the switch to an external electrical circuit. One of the electrical terminals 14, designated a normally closed terminal, is connected to a first stationary contact 18 while another terminal 16, designated a normally open terminal is connected to a second stationary contact 25. The common terminal 15 is connected to a movable contact assembly 20. The movable contact assembly 20 has a snap action blade 22 with a contact pad 24 mounted thereon. Although the present invention is being described in the context of a switch with a snap action blade, the inventive concept can be used with other types of switching mechanisms.

Figure 2:
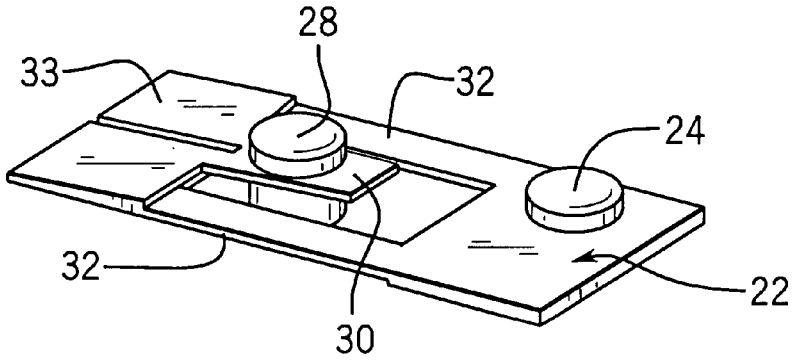
FIG. 2 is an isometric view of a snap action blade of the switch.
Figure 3:
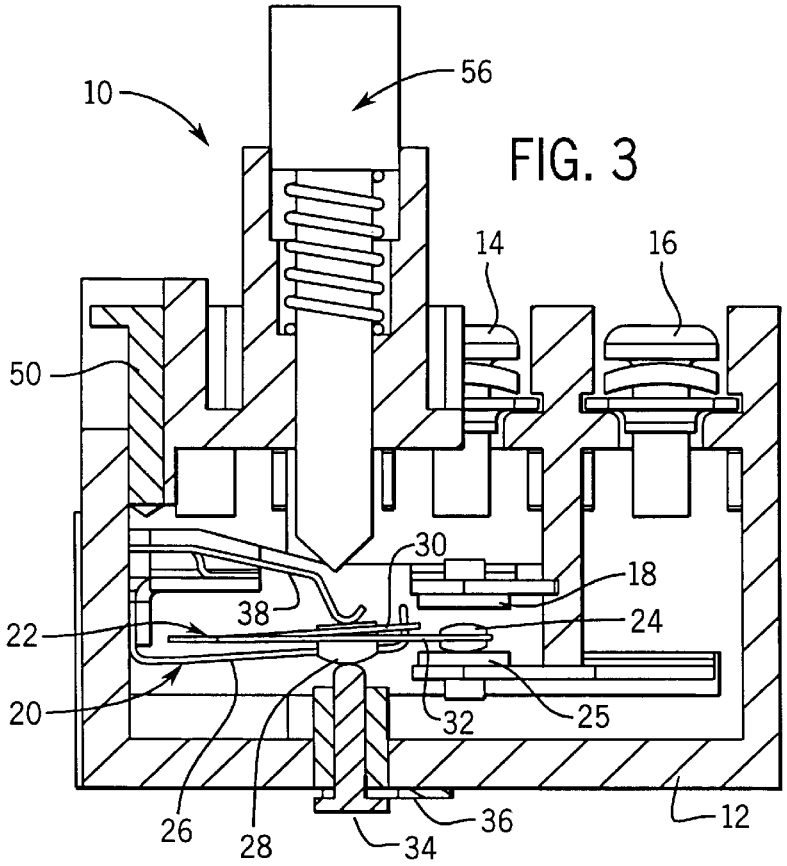
FIG. 3 is a cross sectional view of the switch where the actuator has moved the contacts into an open position.

The snap action blade is similar to the one described in U.S. Pat. No. 5,565,666, the description of which is incorporated herein by reference. Snap action blade 22 is attached to a support lever 26 that extends from a conductor bar which is held in the housing 12 and connected to terminal 15. Specifically, the snap action blade 22 and support lever 26 are coupled to a button 28 which is held in place by a rivet. As shown in detail in FIG. 2, the button 28 engages a center portion 30 of the snap action blade 22. The center portion 30 is flanked by two side legs 32 which extend from the center portion and meet at the contact pad 24. The center portion 30 lies in a first plane and the two side legs 32 lie in a second plane with the two planes intersecting at an end 33 of the snap action blade 22 which is remote from the contact pad 24. The snap action blade 22 has a first configuration where center portion 30 is on one side of the second plane as illustrated in FIG. 1 and has a second configuration where center portion is on the other side of the second plane as illustrated in FIG. 3. As will be described, snap action blade 22 can be levered between these two configurations.

A switch actuator in the form of an actuator pin 34 extends through an aperture in the bottom wall of the housing 12 and is aligned with the button 28 of the movable contact assembly 20. Alternatively, the pin 34 may directly contact the support lever 26. The actuator pin 34 is normally biased outward from the enclosure 12 and away from the movable contact button 28 by a leaf spring 36. Depressing the actuator pin 34 into the housing 12, as shown in FIG. 3, applies force to the button 28 of the movable contact assembly 20. This force is transferred to the center portion 30 of the snap action blade 22 and pushes the first plane of the center portion through the second plane of the two legs 32. When this happens, the contact 24 on the end of the side legs 32 snaps away from the final stationary contact 18 out of the first configuration and into the second configuration where contact 24 is against the second stationary contact 25. This action separates the switch contacts 18 and 24, thereby opening the electric circuit of the switch. This action also deflects a reset spring 38 which abuts the opposite side of the stationary contact button 28 from the actuator pin 34.

As long as the actuator pin 34 is held in the depressed position, against the force of leaf spring 36, force will continue to be exerted upon the snap action blade 22 maintaining switch contacts 18 and 24 in the open position. However, when the external force is released from the actuator pin 34, the force of the leaf spring 36 causes the pin to move outward from the housing 12. Once the actuator pin 34 moves away from the button 28, the force of the reset spring 38 against the button 28 moves the plane of center portion 30 of the snap action blade 22 downward through the second plane of the legs 32. This action toggles snap action blade 22 from the second configuration of FIG. 2 into the first configuration at which the movable contact pad 24 abuts the first stationary contact 18 as shown in FIG. 1. In the first configuration of the snap action blade, switch contacts 18 and 24 close completing the electric circuit.

Thus with the reset spring 38 abutting the movable contact button 28, the snap action blade returns to the closed position immediately when the force of the actuator pin 34 is released, thus causing switch 10 to reset automatically to the closed position.

Figure 4:
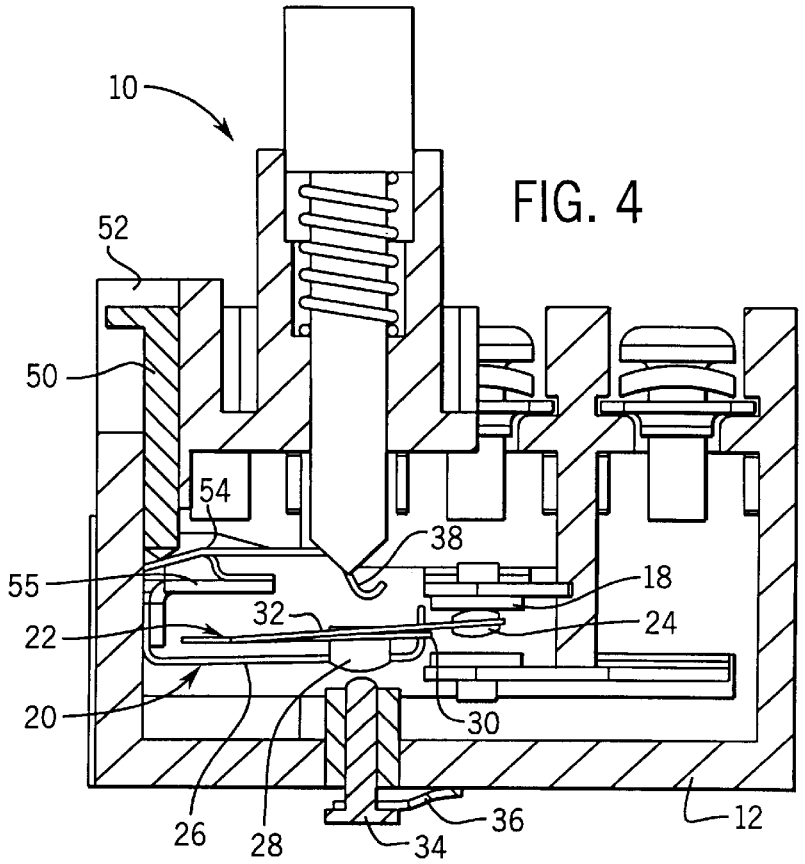
FIG. 4 is a cross sectional view through the switch configured for a manual reset mode with the contacts in a closed position.

With reference to FIG. 4, the automatic reset feature can be defeated to require that the switch be reset manually in order to return the switch contacts 18 and 24 to a closed position after being opened. A conversion pin 50 acts as a reset selector and is slidably located within the housing 12 and is accessible through a depression 52. This access allows a user to move conversion pin 50 downward, in the orientation of switch 10 illustrated in the drawings, from the position shown in FIGS. 1 and 3 to the position illustrated in FIG. 4. This causes the interior end of the conversion pin 50 to push against one end of the reset spring 38 causing the spring to pivot about a fulcrum portion 54. The fulcrum portion 54 is welded or riveted to a conductor bar 55 that connects the common terminal 15 to the movable contact assembly 20. This pivoting acts much the same as a see-saw causing the other end of the reset spring 38 to move away from the movable contact button 28. This releases the force previously exerted by the reset spring 38 on the button 28 and the snap action blade 22.

Figure 5:
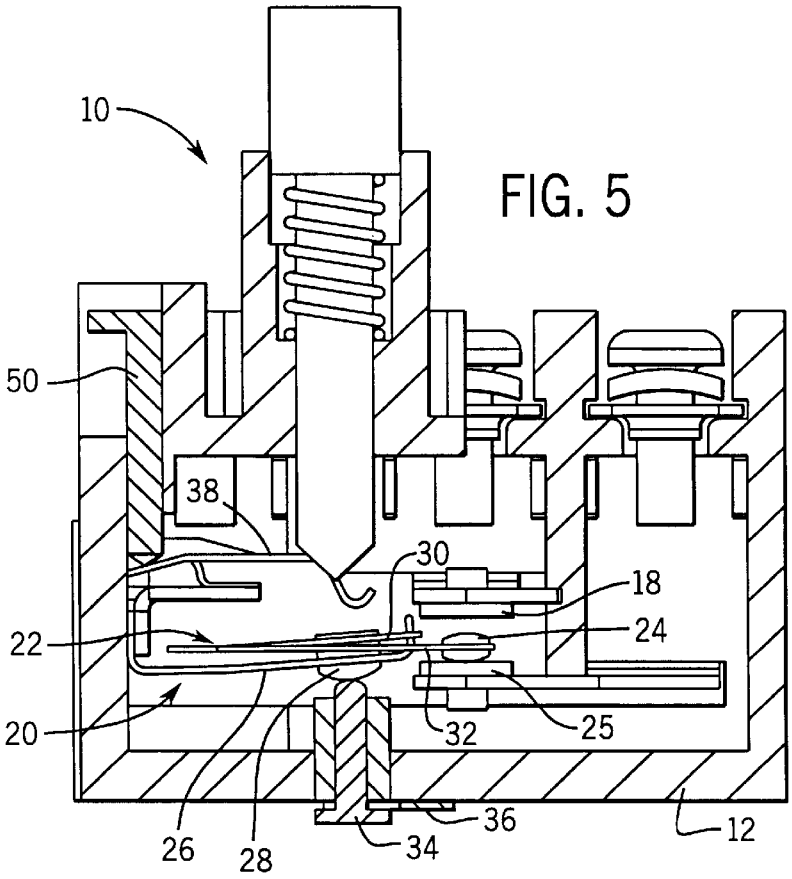
FIG. 5 is a cross sectional view of the switch in the manual reset mode showing the actuator moving the contacts into the open position.
Figure 6:
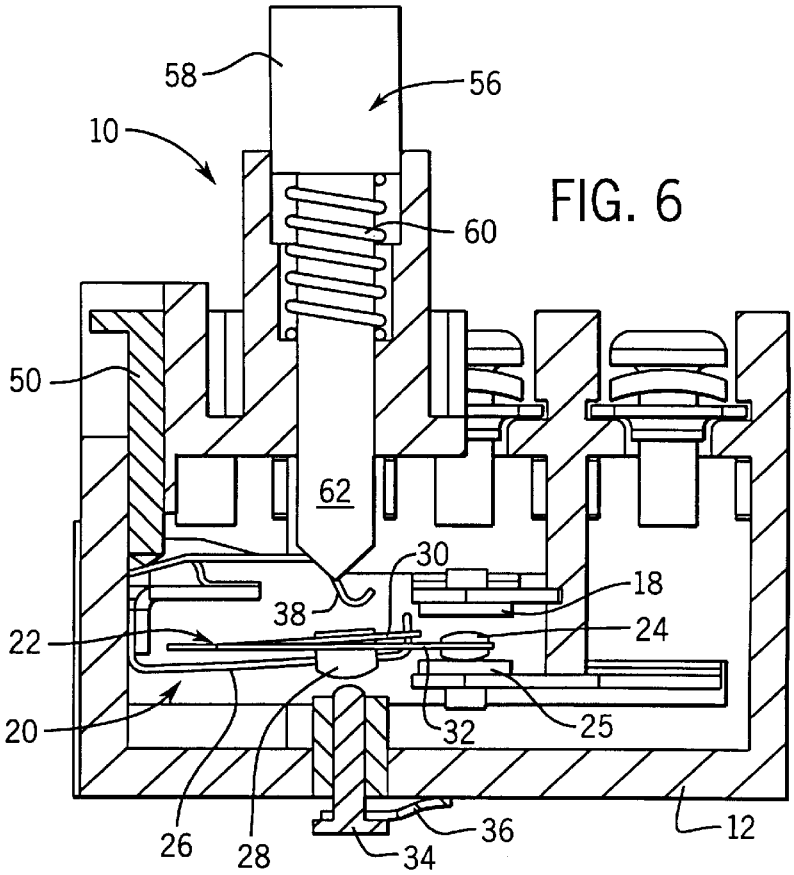
FIG. 6 is a cross sectional of the manual reset mode switch with the contacts in the open position and the actuator inactive.

Referring to FIG. 5, when the actuator pin 34 is depressed into the housing 12, its internal end pushes against the movable contact button 28 causing the snap action blade 22 to toggle to the second configuration at which contact 24 moves away from the stationary contact 18 and against the second stationary contact 25. This snap action opens the electrical circuit. When the actuator pin 34 is released as shown in FIG. 6, leaf spring 36 causes the actuator pin 34 to move outward from the housing 12 into the illustrated position. However, because the reset spring 38 is retracted, a force no longer is exerted upon the moveable contact button 28 which previously caused the snap action blade to toggle back into first configuration at which switch contacts 18 and 24 are closed. As a consequence, the switch contacts 18 and 24 remain in the open state.

Figure 7:
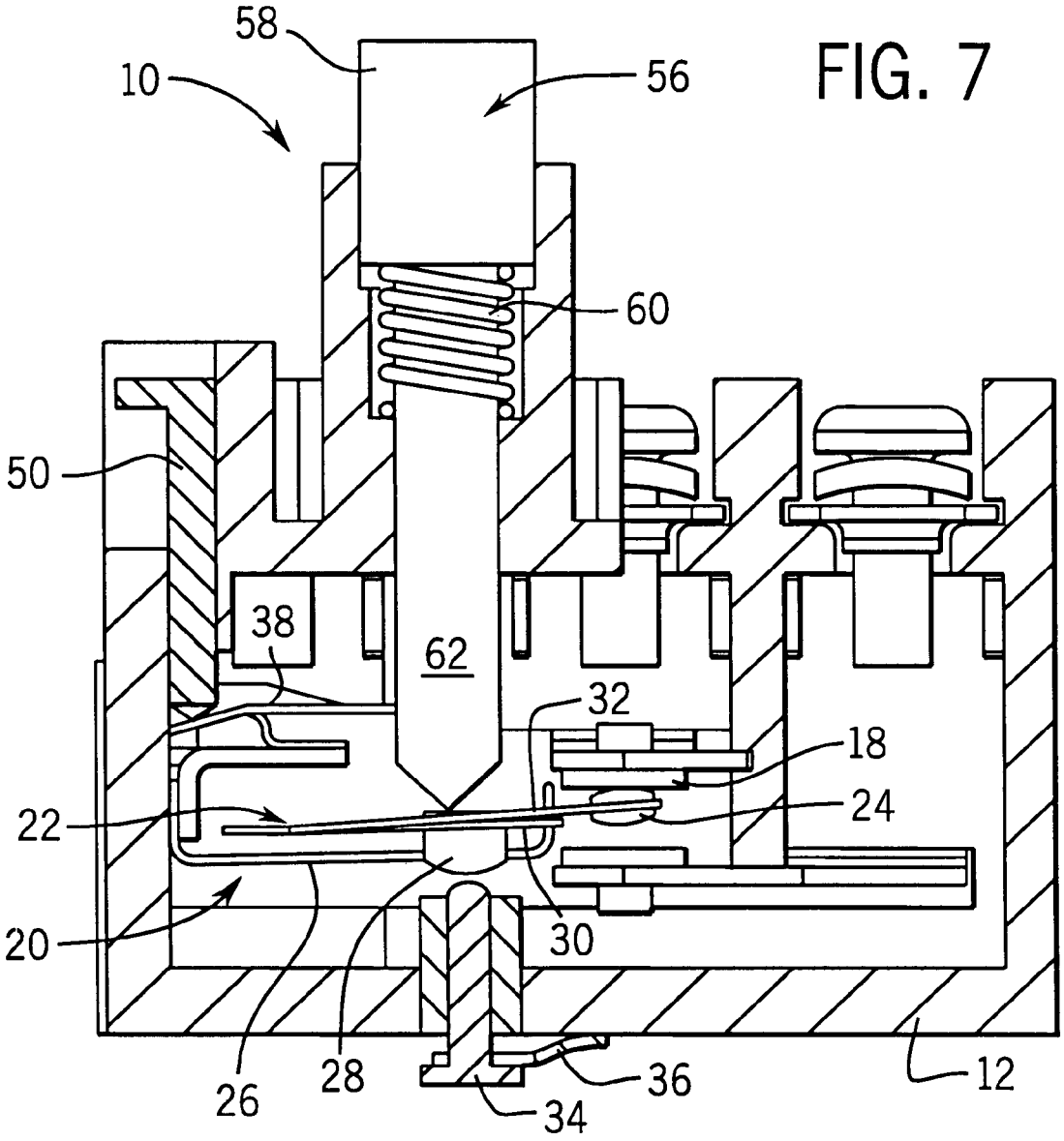
FIG. 7 is a cross sectional view of the switch with the manual reset actuator moving the switch contacts into the closed position.

The switch 10 also includes a manual reset actuator 56 having an end section 58 which projects through an opening in the housing 12. A compression spring 60 biases that end section 58 outward from the housing, so that an interior end 62 of the reset plunger 56 is held away from the movable contact assembly 20 as shown in FIG. 6. However, a person is able to push the end section 58 of the reset actuator 56 into the housing, thereby compressing the spring 60 and moving the interior end portion 62 into contact with the snap action blade 22. Further depression of the manual reset actuator 56 exerts force which toggles the snap action blade 22 into the first configuration at which the movable contact 24 abuts the first stationary contact 18 as seen in FIG. 7. When the person releases the reset actuator 56, the coil spring 60 returns the manual reset actuator 56 into the position illustrated in FIG. 4. However, the bi-stable nature of the snap action blade 22, retains the switch contacts 18 and 24 in their closed position.

Thus when the conversion pin 50 is in the position illustrated in FIGS. 4–7, the automatic reset mode of switch 10 is defeated requiring manual reset in order to return the movable contact 24 from the open state to the closed state.

It should be noted that the user of the electrical switch 10 can move the conversion pin 50 from the inward position illustrated in FIGS. 4–7 to the outward position illustrated in FIGS. 1 and 3 thereby releasing the force of the conversion pin against the reset spring 38 and returning the switch 10 to the automatic reset mode.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. For example, the present inventive concept can be applied to other types of snap action switches and even to non-snap action switches. Accordingly, the scope of the invention should be determined from the following claims and not limited by the above disclosure.

We claim:

1. An electrical switch comprising:

a stationary contact;

a movable contact movable between a first configuration at which the movable contact abuts the stationary contact, and a second configuration at which the movable contact is remote from the stationary contact;

a switch actuator which moves the movable contact into one of the first and second configurations;

a reset spring having a first position at which the reset spring biases the movable contact into the other of the first and second configurations, and having a second position in which the reset spring is disengaged from the movable contact; and a reset selector which selectively engages the reset spring to move the reset spring between the first position and the second position.

2. The electrical switch as recited in claim 1 wherein the reset spring has a fulcrum portion, wherein engagement by the reset selector causes the reset spring to pivot about the fulcrum portion between the first and second positions.

3. The electrical switch as recited in claim 1 wherein the reset spring has first and second end portions, and a fulcrum portion between the first and second end portions, wherein the reset selector engages the first end portion causing the reset spring to pivot about the fulcrum portion between the first and second positions.

4. The electrical switch as recited in claim 1 further comprising a manually operable reset actuator for selectively exerting force which moves the movable contact into the other of the first and second configurations when the switch actuator disengages the movable contact while the reset spring is disengaged from the movable contact.

5. The electrical switch as recited in claim 1 wherein the movable contact is a snap action blade having a contact pad which selectively engages the stationary contact.

6. The electrical switch as recited in claim 5 wherein the snap action blade comprises a center portion, and a first leg and a second leg both joined to the center portion, the first leg and the second leg lying in a first plane and the center portion lying in a second plane, the snap action blade toggling between the first configuration and the second configuration when the first plane and the second plane cross.

7. The electrical switch as recited in claim 6 wherein the contact pad of the snap action blade is coupled to the first leg and the second leg.

8. The electrical switch as recited in claim 1 further comprising:

a housing which encloses the stationary contact and the movable contact; and wherein the movable contact comprises:

a support lever supported by the housing; and a snap action blade having a center portion attached to the support lever and being selectively engaged by the switch actuator and the reset spring, first and second legs both joined to the center portion, and a contact pad coupled to the first and second legs, the center portion lying in a first plane and the first and second legs lying in a second plane, the snap action blade toggling between the first configuration and the second configuration when the first plane crosses the second plane.

9. An electrical switch comprising:

a body of electrically insulating material;

a stationary contact attached to the body;

a snap action blade coupled to the body and movable with respect thereto into first and second configurations, the snap action blade having a contact pad that engages the stationary contact in the first configuration and disengages the stationary contact in the second configuration;

a switch actuator which moves the snap action blade between the first and second configurations;

a reset spring having a first position at which the reset spring biases the movable contact toward one of the first and second configurations, and having a second position in which the reset spring is disengaged from the movable contact; and a reset selector which selectively engages the reset spring to move the reset spring between the first position and the second position.

10. The electrical switch as recited in claim 9 wherein the snap action blade comprises a center portion and first and second legs both joined to the center portion, the contact pad being coupled to the first and second legs, the first and second legs lying in a first plane and the center portion lying in a second plane, the snap action blade toggling between the first and second configurations when the first plane crosses the second plane.

11. The electrical switch as recited in claim 9 wherein the reset spring has a fulcrum portion connected to the body, wherein engagement by the reset selector causes the reset spring to pivot about the fulcrum portion between the first and second positions.

12. An electrical switch comprising:

a body of electrically insulating material;

a stationary contact attached to the body;

a support lever supported by the body;

a snap action blade having a center portion attached to the support lever, first and second legs joined to the center portion, and a contact pad coupled to the first and second legs, the first and second legs lying in a first plane and the center portion lying in a second plane, the snap action blade toggling between a first configuration and a second configuration when the first plane crosses the second plane, the contact pad abutting the stationary contact in the first configuration and being remote from the stationary contact in the second configuration;

a switch actuator which moves the snap action blade between the first and second configurations;

a reset spring having a first position at which the reset spring biases the movable contact into one of the first and second configurations, and having a second position in which the reset spring is disengaged from the movable contact; and a reset selector which selectively engages the reset spring to move the reset spring between the first position and the second position.

* * * * *